US007334622B2

(12) United States Patent
Stade

(10) Patent No.: US 7,334,622 B2
(45) Date of Patent: Feb. 26, 2008

(54) HAND-HELD DEVICE FOR TRANSFERRING A FILM ONTO A SUBSTRATE AND HAVING AN APPLICATION MEMBER COMPRISING A PLURALITY OF APPLICATION EDGES

(75) Inventor: Volker Stade, G Hofheim a. (DE)
(73) Assignee: Societe BIC, Clichy (FR)

( * ) Notice: Subject to any disclaimer, the term of this patent is extended or adjusted under 35 U.S.C. 154(b) by 61 days.

(21) Appl. No.: 10/646,376

(22) Filed: Aug. 21, 2003

(65) Prior Publication Data

US 2004/0118523 A1 Jun. 24, 2004

Related U.S. Application Data

(63) Continuation of application No. PCT/EP02/03950, filed on Apr. 9, 2002.

(30) Foreign Application Priority Data

Apr. 9, 2001 (EP) ..... 01108860

(51) Int. Cl.
*B32B 37/22* (2006.01)

(52) U.S. Cl. ..... 156/577; 156/527; 118/76; 118/200; 118/257; 242/588.3; 242/588.6; 206/411

(58) Field of Classification Search ..... 156/577, 156/579, 574, 523, 238, 540; 118/76, 200, 118/257; 242/170, 171, 588, 588.2, 588.6, 242/160.2, 160.4
See application file for complete search history.

(56) References Cited

U.S. PATENT DOCUMENTS 4,853,074 A * 8/1989 Manusch et al. ..... 156/577
5,281,298 A * 1/1994 Poisson et al. ..... 156/579
5,462,633 A * 10/1995 Manusch et al. ..... 156/577
5,772,840 A * 6/1998 Morinaga ..... 156/540
6,105,650 A * 8/2000 Manusch et al. ..... 156/540
6,729,377 B2 * 5/2004 Huthmacher ..... 156/577

FOREIGN PATENT DOCUMENTS

JP 11157290 A * 6/1999

* cited by examiner

*Primary Examiner*—Mark A Osele
(74) *Attorney, Agent, or Firm*—Jones Day

(57) ABSTRACT

The invention relates to a hand-held device for transferring a film of, for example, adhesive, covering, or colored material from a backing tape onto a substrate. The device has a housing in which a supply of the backing tape is arranged, and an application member projecting from the housing and having a first and a second application edge. The backing tape is wound around the free end and the application edges of the application member and extends into the housing with tape sections at the lower longitudinal side facing the substrate during the mode of operation and at the upper longitudinal side opposite the lower longitudinal side. For improvement of the view to the film application during the mode of operation, the second application edge projects from the lower longitudinal side of the application member.

16 Claims, 3 Drawing Sheets

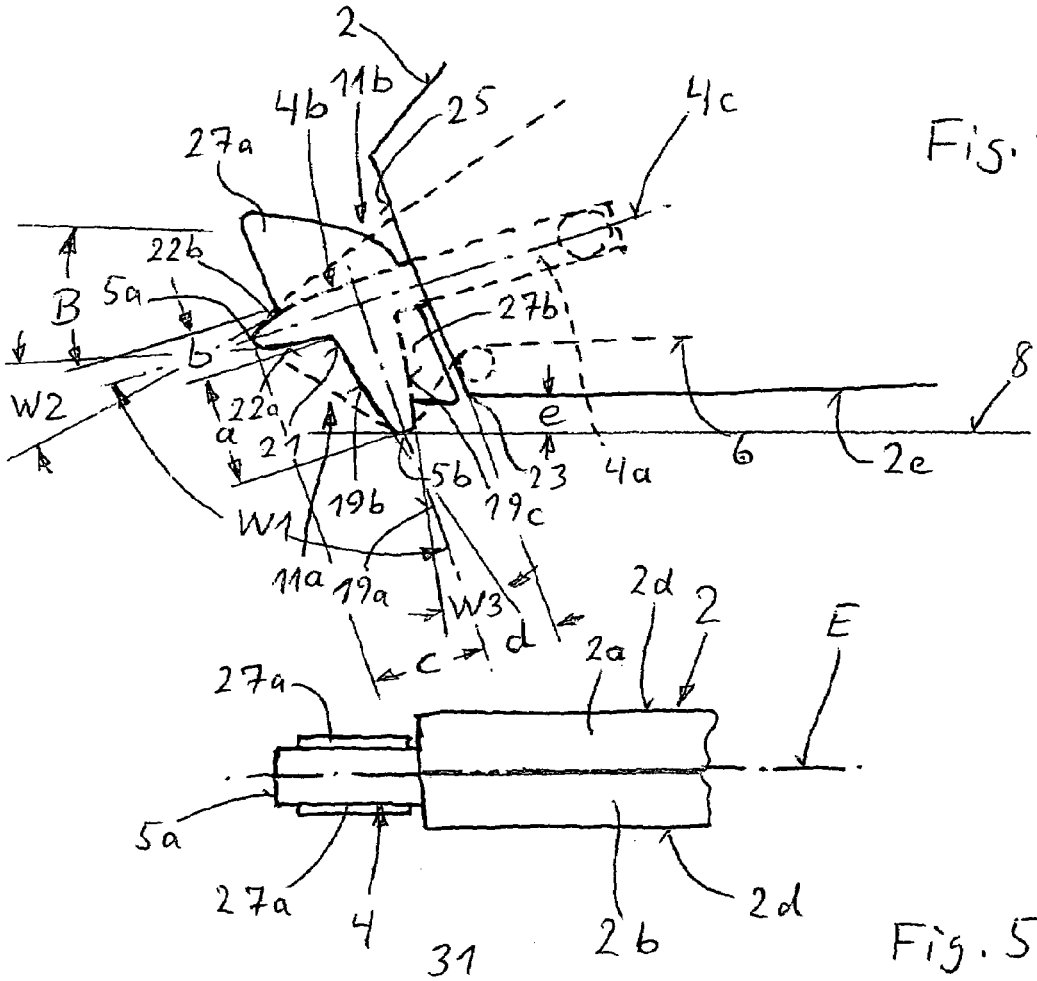
Fig. 4
Fig. 5
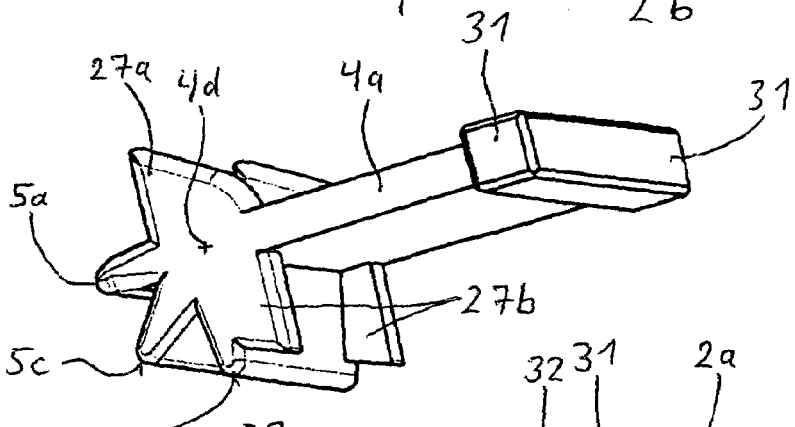
Fig. 6
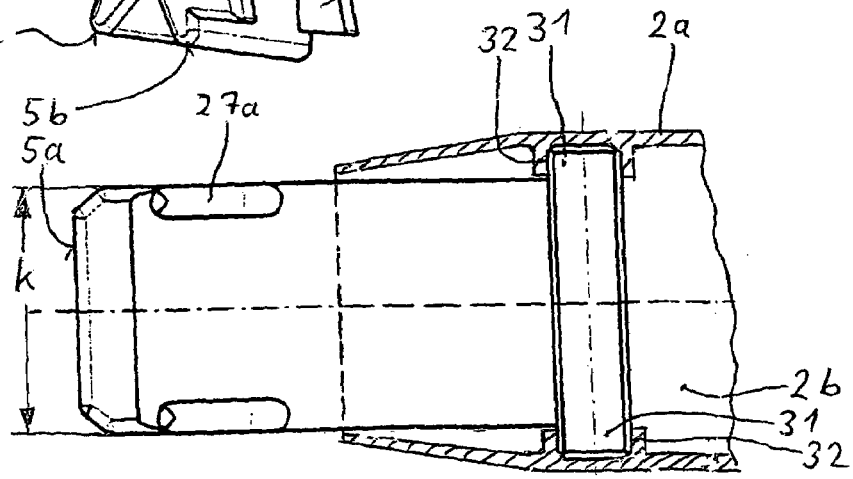
Fig. 7

HAND-HELD DEVICE FOR TRANSFERRING A FILM ONTO A SUBSTRATE AND HAVING AN APPLICATION MEMBER COMPRISING A PLURALITY OF APPLICATION EDGES

CROSS-REFERENCE TO RELATED APPLICATIONS

This application is a continuation of PCT Application No. PCT/EP02/03950, filed on Apr. 9, 2002, which claims priority to European Patent Application 01 108 860.6, filed Apr. 9, 2001. The entire contents of these two applications is expressly incorporated herein by reference.

FIELD OF THE INVENTION

The invention relates to a hand-held device for applying a film to a substrate.

BACKGROUND OF THE PRIOR ART

A hand-held device of this type is described in U.S. Pat. No. 4,853,074, dated Aug. 1, 1989, and related publication EP 0 313 719 A2. In this previously known embodiment, the hand-held device comprises according to FIG. 4d a first front application edge arranged approximately mid-centrally in relation to the longitudinal central axis of the application member and a second heel application edge which is offset backwards in relation to the first application edge and formed by a rounded projection forwardly directed, which results between the bottom surface of the application member and a recess in the application member arranged directly behind the front application edge. In this known embodiment, a reference as to arrangement between the application edges and the housing of the hand-held device is not represented. It becomes evident, however, from a comparison with FIG. 1 of said printed publication that the second or rear application edge is covered by the first application edge when it is adjacent to the substrate during operation, wherein the front application edge is at a small distance above the rear application edge. As a result thereof, the view of the rear application edge is obstructed, so that an exact positioning of the film application is hardly possible or at least is impaired considerably in this known embodiment.

SUMMARY OF THE INVENTION

The present invention facilitates the use of a hand-held device for applying a film to a substrate, such as by improving the user's view of the film application he is about to perform.

In the configuration according to the invention, the second application edge forms a projection which projects from the application member on its longitudinal side facing the substrate or on its bottom side. This configuration leads to a greater distance between the application edges, which is directed transversely to the application member. When the second application edge is positioned adjacent to the substrate during operation, the view of the portion of the application member containing the second application edge thus is improved. Therefore a person using the device can apply the film onto the substrate with reduced attention and with an improved positioning accuracy.

It is a further advantage to position the first application edge in the upper side portion of the application member or the side portion turned away from the second application edge. Thereby an even greater distance between the application edges is achieved, by which the view of the second application edge is further enhanced.

In addition, handling of the hand-held device is improved, in particular when the second application edge exceeds the adjacent lower edge of the housing or the bottom side of the housing.

It is a further advantage if the head of the application member is vertically movable or rotatably mounted and pre-tensioned by an elastic restoring force in the lower end position. As a result thereof, the amount of the pressure effective in the operating mode can be limited, namely to the amount of the elastic restoring force. When pressing the application member against the substrate at a force exceeding the restoring force, the pressure member yields by moving upwards. In the absence of said pressure it is automatically moved back into its lower starting position by the elastic restoring force.

The invention furthermore proposes features which lead to simple embodiments of small designs, which can be combined with or integrated into the housing of convenient size in an advantageous fashion, which result in good guidance for the backing tape and moreover enable simple and inexpensive manufacture.

BRIEF DESCRIPTION OF THE DRAWINGS

In the following, the invention shall now be explained in more detail with the aid of drawings and preferred embodiments.

FIG. 4 shows an enlarged side view of an application member of the handheld device;

FIG. 5 shows a top view of the application member according to FIG. 4;

FIG. 6 shows a modified configuration of an application member in a perspective bottom view;

FIG. 7 shows a top view of the application member according to FIG. 6;

DETAILED DESCRIPTION OF THE INVENTION

Figure 1:
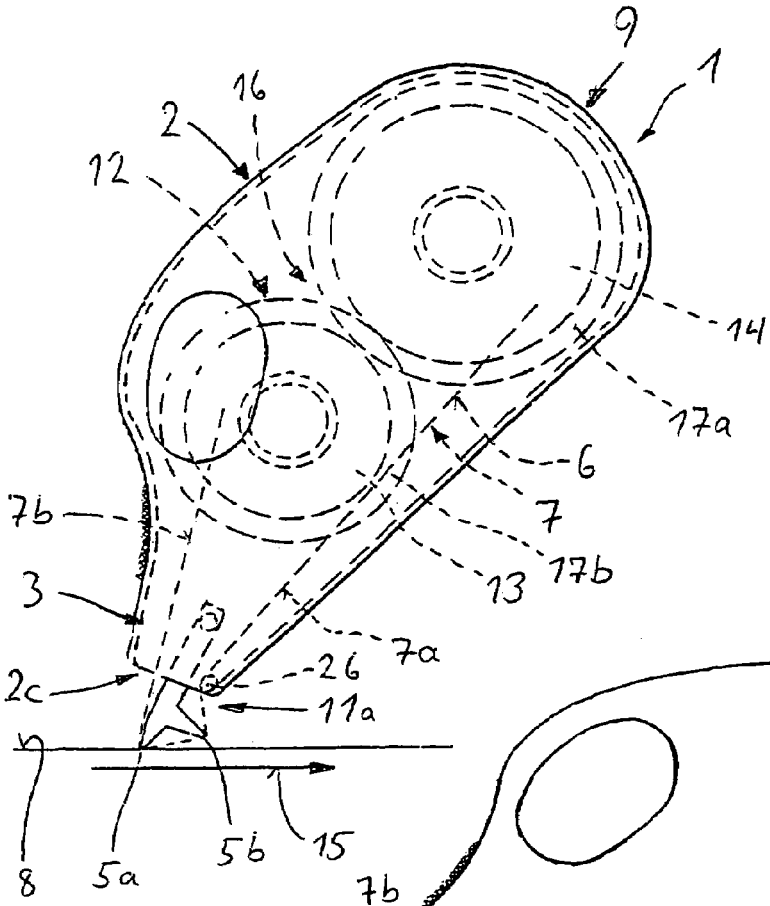
FIG. 1 shows a side view of a hand-held device according to the invention in the first position of operation.

The hand-held device 1, illustrated in FIG. 1, comprises a housing 2 of convenient size, which consists of two longitudinally or transversely divided housing parts 2*a*, 2*b* (see FIG. 5) which are mounted to each other in a detachable or non-detachable fashion. The left-hand and lower end of the housing 2 or the hand-held device 1 in FIG. 1 is its working end 3. A preferably wedge-shaped application member 4 is provided at writing end 3. Application member 4 is of longitudinal design, and is held in the housing 2 by means of a shaft 4*a*. Application member 4 extends outwardly with an application head 4*b* following the shaft 4*a* and projects from the circumference of the housing 2. The longitudinal mid-central axis of the application member 4 is identified by 4*c* (see, e.g., FIGS. 4 and 8).

In the portion of its application head 4*b*, the application member 4 has two application edges 5*a*, 5*b* spaced apart from each other at right angles to the longitudinal mid-central axis 4*c* and preferably also longitudinally to the longitudinal mid-central axis 4*c*. Application edges 5*a*, 5*b* are slightly rounded and extend at right angles to the drawing plane in the working positions according to FIGS. 1 to 3.

In the present exemplary embodiment, the hand-held device 1 serves for transferring a film 6 of covering and/or colored and/or adhesive material from a film-like backing tape 7 onto a substrate 8, for example a sheet of paper. The backing tape 7 extends from a supply 9 located in the cavity of the housing 2 to the application head 4*b* in the region of at least one housing aperture 2*c*, is wound around the application head 4*b* and is re-fed to the cavity of the housing 2. The backing tape section approaching the application head 4*b* at the here lower longitudinal or approach side 11*a* of the application member 4 is identified by 7*a*. The backing tape section being re-fed to the housing 2 at the upper longitudinal or return side 11*b* of the application head 4*b* is identified by 7*b*. The winding plane E (see FIG. 5) extends roughly in parallel and preferably midcentrally to the broad sides 2*d* of the housing 2, which extend, for example parallel to each other. The returning backing tape portion 7*b* extends to a take-up device 12 mounted in the cavity of the housing 2, wherein the take-up device 12 can be a take-up spool 13, which is rotatably mounted in the housing 2. The supply 9, too, can be formed by a spool, namely a supply spool 14, which is rotatably mounted in the housing 2. In the exemplary embodiment the supply 9 and the take-up device 12 are arranged behind one another, the take-up device 12 being arranged between the supply 9 and the working end 3 of the housing 2.

Figure 2:
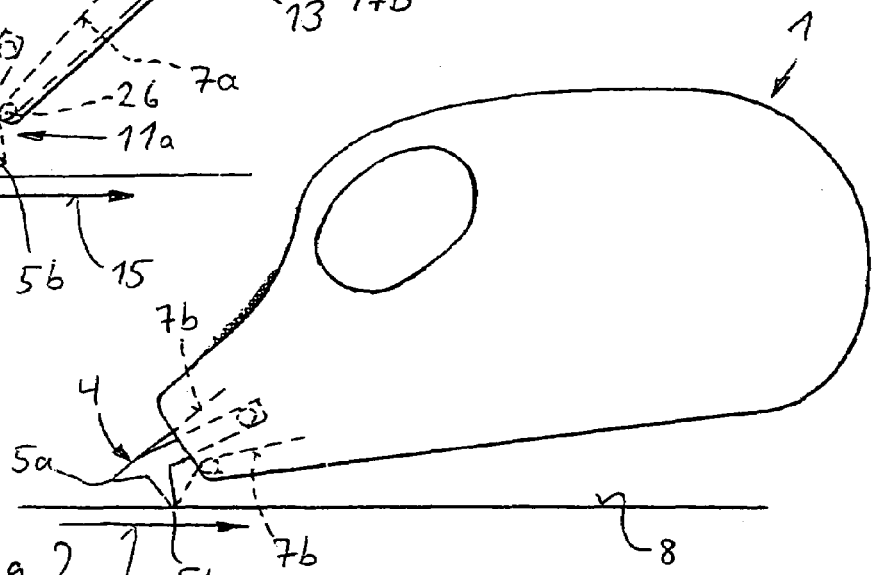
FIG. 2 shows the hand-held device of FIG. 1 in a second position of operation.
Figure 3:
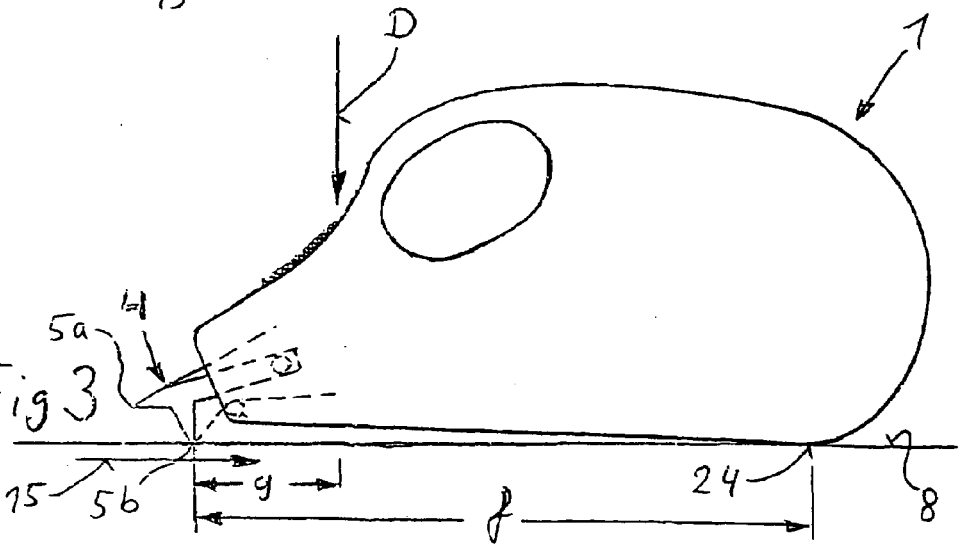
FIG. 3 shows the hand-held device of FIG. 1 in a third position of operation.

The embodiment according to the invention enables use of the hand-held device 1 in several positions of operation according to FIGS. 1 to 3. In the first position of operation according to FIG. 1, the hand-held device 1 is set against the substrate 8 with the first application edge 5*a* and is slightly pressed in such a position in which the second application edge 5*b* is at a distance from the substrate 8. By moving the handheld device 1 in the application direction identified by 15, the backing tape section 7*a* is pulled from the supply 9 due to the friction at the substrate 8, wherein the film 6 remains on the substrate surface and the backing tape section 7*b* is moved into the cavity of the housing 2, here to the take-up device 12. Said take-up device 12 is driven by the backing tape section 7*a* approaching the application member 4 or its tensile force. In the present exemplary embodiment this is effected by providing a rotational drive connection 16 between the supply spool 14 and the take-up spool 13, e.g., in the form of overlapping rubbing surfaces 17*a*, 17*b* at the peripheral edges of the walls of the spool. The winding diameter of the spools 13, 14 is dimensioned large enough for the take-up spool 13 to attempt to pull in the backing tape 7, also in case of a full supply spool 14, at a speed which is higher than the speed at which the backing tape 7 is wound off the supply spool 14. By a slip friction clutch 18 integrated in the rotational drive connection 16, which here is formed by the rubbing surfaces 17*a*, 17*b* which are in frictional contact with one another, it is ensured that the take-up spool 13 pulls in the backing tape 7 always at a certain tensile stress, whereby the formation of loops in the backing tape 7 is avoided. The application movement 15 is directed to the side towards which the bottom side of the application member 4 facing the substrate 8 is directed.

The second application edge 5*b* is formed by a projection 19 projecting from the lower longitudinal side of the application member 4 facing the substrate 8 in the mode of operation, wherein said projection 19 can have the shape of a web sticking out transversely, whose mid-central plane 19*a* encloses an angle W1 of approximately 30° to 135°, in particular approximately 90°, with the longitudinal mid-central axis 4*c*, and whose height is referred to by a, which is several times the cross-sectional dimension b, of the shaft 4*a*, preferably about two to three times the dimension b. The front surface 19*b* (turned away from the shaft 4*a*) and the rear surface 19*c* (facing the shaft 4*a*) are preferably surfaces diverging towards the longitudinal mid-central axis 4*c*, as a result of which the second application edge 5*b* is given stability. Between the application edges 5*a*, 5*b*, the application head 4*b* comprises a trough-shaped recess 21 preferably extending at right angles to the winding plane E, said recess 21 being angular-shaped in the exemplary embodiment, in particular at an obtuse angle of about 110°. The flank 22*a* bordering the first application edge 5*a* encloses an acute angle W2 with a flank 22*b* bordering the application edge 5*a* at the opposite side. Angle W2 can roughly correspond to the angle W3 between the surfaces 19*b*, 19*c* of the second application edge 5*b* and amount, e.g., to about 10° to 20°. Like the second application edge 5*b*, the first application edge 5*a*, too, is given stability as a result thereof, particularly with respect to a tensile stress acting upon the first application edge 5*a* in a transverse direction during operation when the film 6 is applied.

In the present configuration, the second application edge 5*b* is spaced apart from the first application edge 5*a* at a distance c extending roughly in parallel to the longitudinal mid-central axis 4*c* and being offset backwards, which can be about equal to about half the height a of the second application edge 5*b*. The distance d of the second application edge 5*b* from the adjacent border 23 of the housing 2, which extends also in parallel to the longitudinal mid-central axis 4*c*, can be about equal to or smaller than the distance c.

The height a of the second application edge 5*b* exceeds or extends beyond the adjacent border 23 of the housing 2. In the present exemplary embodiment, in which the side of the housing 2 facing the substrate 8 (here a narrow side) is designed to be straight in the direction towards its working end, the height a is dimensioned to be large enough for the second application edge 5*b* to exceed also this side surface 2*e* of the housing by the measure e. This makes sure that when the hand-held device 1 is pressed against the substrate 8, the second application edge 5*b* touches the substrate 8 and the housing 2 touches the substrate 8 at a support point 24 which is spaced apart from the second application edge 5*b* by a distance f which is preferably greater than the distance g at which a pressure D from the second application edge 5*b* resulting in the mode of operation of the hand-held device 1 acts at the housing. As a result thereof, the hand-held device 1 cannot only be used at an application position according to FIG. 2—which is inclined with respect to FIG. 1—, in which the first application edge 5*a* is spaced apart from the substrate 8, but also in a position in which the housing 2 touches the substrate 8 in accordance with FIG. 3.

At the aperture border facing the substrate 8, a rounded diverting element 26 is formed at the housing 2, preferably in one-part form, at which the backing tape section 7*a* is diverted at an obtuse angle and supported. As far as the guidance of the backing tape 7 is concerned before it has arrived at the second application edge 5*b* and after it leaves the first application edge 5*a*, guiding webs 27*a*, 27*b* are provided, which project from the approach side 11*a* and the return side 11*b*, respectively, and which have between them a distance conforming to the width of the backing tape 7, so that the inner sides of the guiding webs 27 form guiding surfaces for the backing tape 7. The guiding web(s) 27 provided at the approach side 11*a* extend to the adjacent outer surface 25 of the housing 2 at the border of the aperture, by taking account of clearance, whereby the lower aperture region is largely covered laterally.

The application member 4 can be held in the housing 2 so rigidly and can be designed to be so inflexible that the application edges 5*a*, 5*b* are basically immovable in a direction transverse to the longitudinal mid-central axis 4*c*.

The application member 4, however, can also be designed or arranged such that its application head 4*b* is movable towards the side turned away from the second application edge 5*b* against an elastic restoring force and is returned into its starting position by the restoring force. The appertaining region of movement is identified by B. The size of the housing aperture 2*c* is dimensioned accordingly. The restoring force is preferably great enough for the application head 4*b* to evade elastically when the pressing force exceeds a non-detrimental value during transferring of the film 6, whereby a detrimental pressing force is avoided. This movability can be ensured by the shaft 4*a* being elastically flexible in front of its rear point of attachment or by the application member 4 as a whole being rotatably mounted in the housing 2 about a swivel axis arranged in the rear portion of the shaft 4*a* and being capable of being reset into its represented starting position by a not represented restoring spring.

It is a further advantage to design the shaft 4*a* of the application member 4 to be elastically torsional or rotatable about its longitudinal axis in front of its rear point of attachment. As a result thereof, the application edges 5*a*, 5*b* can adapt to different positions of the substrate 8 in case of inclinations of the hand-held device 1 and return automatically into their average swiveling position in the absence of pressure due to their elasticity.

The exemplary embodiment according to FIGS. 6 and 7, in which the same or similar parts are given the same reference numbers, differs from the exemplary embodiments described in the foregoing in several respects.

On the one hand, the application member 4 comprises a third application edge 5*c*, which is preferably arranged mid-centrally between the first application edge 5*a* and the second application edge 5*b*, the mid-central plane thereof enclosing an angle of approximately 45° with the longitudinal mid-central axis 4*c* or the first application edge 5*a*. The third application edge 5*c* thus projects diagonally to the front from the lower longitudinal side 11*a* of the application member 4. The third application edge 5*c*, too, can have a wedge-shaped cross-sectional shape. In the exemplary embodiment according to FIGS. 6 and 7, the heights of the first and second application edges 5*a*, 5*b* according to FIG. 1 or 4 and the height of the third application edge 5*c* can correspond to the height a of the second application edge 5*b*. It is also possible that all the three application edges 5*a*, 5*b*, 5*c* are identical in height, so that their free ends are spaced apart from a mid-central transverse axis 4*d* of the shaft 4*a* sketched out in FIG. 6 by the same distance and thus are located on an imaginary cylinder section plane curved around the swivel axis 4*d*.

On the other hand, the shaft 4*a* has at its rear end, on one or on both sides, a transversely protruding support pin 31 of a non-circular, preferably rectangular or square, cross-section, with which it engages into a correspondingly shaped non-circular plug recess 32 of the housing 2 and is anchored therein in a form-fit fashion. Thereby the shaft 4*a* can be held in the housing in a simple manner, wherein, in the event of the shaft 4*a* being composed of elastically flexible material, the shaft 4*a* can be bent out elastically with the application head 4*b* in the winding plane E. The at least one plug recess 31 is preferably positioned such that the shaft 4*a* is in its spring-neutral mid-central position in the lower portion of the area of movement referred to by B in FIG. 4. In this exemplary embodiment, too, the application head 4 can bend upwards elastically. The plug recesses 32 are formed to be attached in one part to the housing 2 or the housing parts 2*a*, 2*b* and can be bordered by walls protruding inwards from the housing wall, as is illustrated in FIG. 7.

The third application edge 5*c* enables the use of the hand-held device 1 in an area between the positions according to FIGS. 1 and 2. In order to enable trouble-free sliding of the backing tape 7, the application edges 5*a*, 5*b*, 5*c* are rounded in a the form of a cylindrical segment.

The shaft 4*a* can have the shape of a bar, e.g., round or square or the like, as is shown in FIGS. 4 and 5, or it can be designed to be edge-shaped, as is illustrated in FIG. 6 and following, in which the horizontal width k of the shaft 4*a* is many times its thickness b. In both embodiments, the application head 4*b* is elastically torsional due to the length of the shaft 4*a* and its elasticity, so that the application edges 5*a*, 5*b*, 5*c* adapt to the surface of the substrate 8 when subjected to pressure in the mode of operation and, in the absence of pressure, bend back elastically into their neutral position due to the elasticity.

Figure 8:
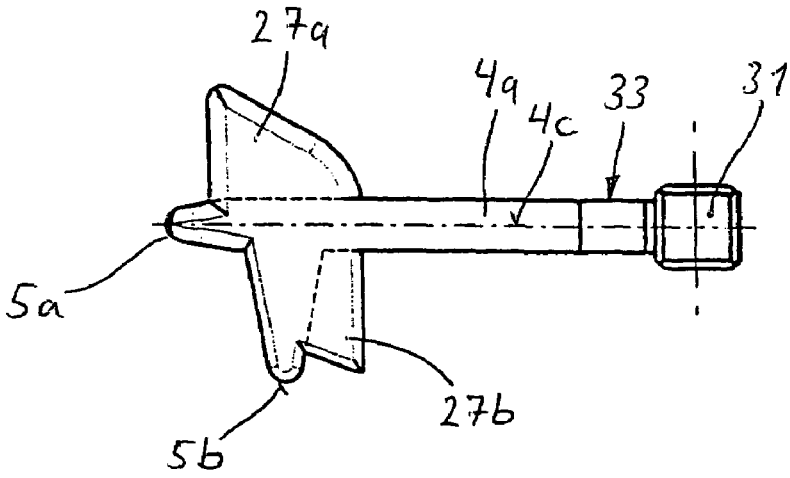
FIG. 8 shows a further modified configuration of an application member in a side view.
Figure 9:
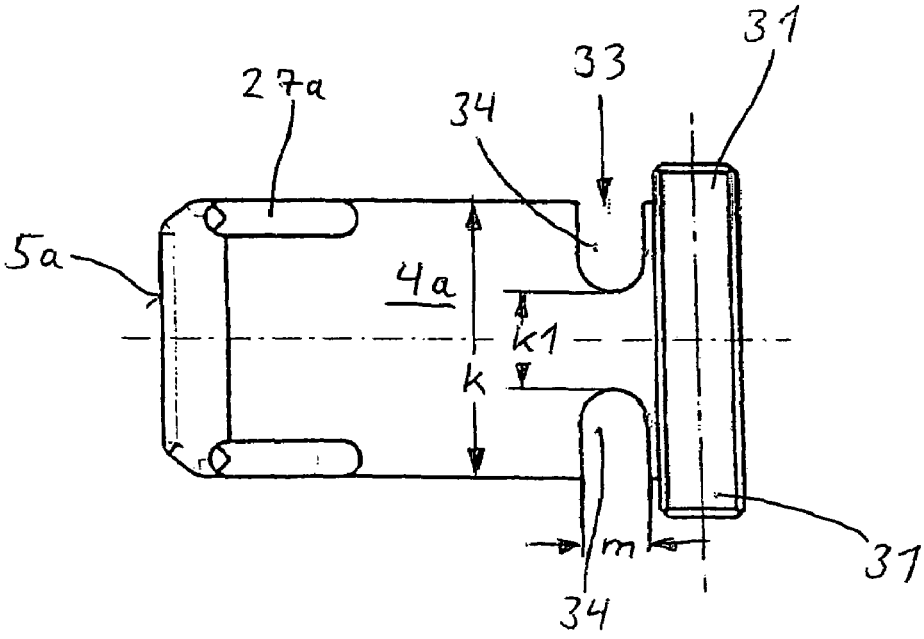
FIG. 9 shows a top view of the application member according to FIG. 8.

The flexibility and/or torsional ability of the shaft 4*a* is increased or mainly focused on or restricted to a certain area of length when the shaft 4*a* comprises a necking 33, which can be designed, e.g., according to the exemplary embodiment as shown in FIGS. 8 and 9. In this configuration, the shaft 4*a* is necked by two recesses 34 arranged opposite to each other and which can be formed by slots whose width m is about equal or greater than the thickness b of the shaft 4*a*. The base of the slits is preferably rounded in a concave fashion. In the present exemplary embodiment, the recesses 34 limit the shaft 4*a* in the region of the necking 33 to a width 1, which is about equal or greater than its thickness b. The necking 33 can follow directly to the support pin 31, or the recesses 34 can be spaced apart from the support pins 31 by a preferably low axial distance. Moreover, the application head 4*b* in the exemplary embodiment according to FIGS. 8 and 9 is designed in conformity with the exemplary embodiment according to FIG. 4.

The design of the rear end portion of the shaft 4*a* with at least one support pin 31 and the necking 33 can be effected in all the above-described exemplary embodiments or also in application members of other configurations.

It is possible within the framework of the invention to drop the application edge 5*b* in the exemplary embodiment according to FIGS. 6 and 7 and to design the application member 4 only with the application edge 5*a* and an application edge 5*c* extending at an acute angle thereto according to FIG. 6. It is also possible to achieve the advantages described, at least to some extent, in such an application member 4 with two application edges.

The application member 4 and preferably also the housing 2 and the spools 13, 14 are preferably die-cast parts, especially of plastic material. This enables fast and inexpensive manufacture of accurate parts also in case of difficult shapes.

The invention claimed is:

1. A hand-held device for transferring a film from a backing tape onto a substrate, said device comprising:

a housing in which a supply of the backing tape is arranged; and an application member projecting from said housing and having a front end with a free end and at least a first application edge and a second application edge, the backing tape being wound around said free end and said application edges of said application member and extending into said housing with tape sections at a lower longitudinal side of said application member facing the substrate during operation and at an upper longitudinal side of said application member opposite said lower longitudinal side; wherein:

said second application edge projects from said lower longitudinal side of said application member, said first application edge and said second application edge are linear, said first application edge and said second application edge are arranged asymmetrically in relation to a longitudinal axis of said application member, and said first and second application edges have mid-central planes enclosing an angle of approximately 30° to 120°.

2. A hand-held device according to claim 1, wherein said mid-central planes of said first and second application edges enclose an angle of about 45° to 90°.

3. A hand-held device according to claim 1, wherein:

the height of said second application edge is greater than a cross-sectional dimension of said first application edge.

4. A hand-held device according to claim 1, wherein:

said application member has a shaft; and the height of said second application edge is greater than a cross-sectional dimension of said shaft of said application member.

5. A hand-held device according to claim 1, wherein:

the cross-sectional shape of said second application edge is convergent.

6. A hand-held device according to claim 5, wherein:

the cross-sectional shape of said second application edge is wedge-shaped.

7. A hand-held device according to claim 1, wherein:

said housing has a lower border and a bottom side; and said second application edge extends beyond at least one of said adjacent lower border of said housing or said bottom side of said housing.

8. A hand-held device according to claim 1, wherein said application member has a front end portion movable upwards against an elastic restoring force.

9. A hand-held device according to claim 8, wherein:

said application member has a rear end portion fixedly held in said housing; and said application member is elastically flexible in a vertical direction in at least a partial area of its length.

10. A hand-held device according to claim 1, wherein said application member is rotatably mounted about a swivel axis extending in said housing upwards against an elastic restoring force.

11. A hand-held device according to claim 1, further comprising at least one guiding web projecting backwards from a backside of said second application edge on at least one side, said at least one guiding web having an inner side guiding the backing tape being wound around said second application edge.

12. A hand-held device according to claim 1, wherein said second application edge is offset backwards in relation to said first application edge in a direction closer to said housing.

13. A hand-held device according to claim 1, wherein said first application edge is the front end of a longitudinally extending shaft of said application member.

14. A hand-held device according to claim 1, wherein said application member is formed with a necking.

15. A hand-held device according to claim 14, wherein:

said application member has a rear end closer to said housing than said front end; and said necking is formed at said rear end of said application member.

16. A hand-held device for transferring a film from a backing tape onto a substrate, said device comprising:

a housing in which a supply of the backing tape is arranged; and an application member projecting from said housing and having a front end with a free end and at least a first application edge and a second application edge, the backing tape being wound around said free end and said application edges of said application member and extending into said housing with tape sections at a lower longitudinal side of said application member facing the substrate during operation and at an upper longitudinal side of said application member opposite said lower longitudinal side; wherein:

said second application edge projects from said lower longitudinal side of said application member, said first application edge and said second application edge are linear, said first application edge and said second application edge are arranged asymmetrically in relation to a longitudinal axis of said application member, said first application edge, said second application edge and said application member are integral, and said first and second application edges have mid-central planes enclosing an angle of approximately 30° to 120°.

* * * * *